US006374152B1

(12) United States Patent
Wepfer et al.

(10) Patent No.: US 6,374,152 B1
(45) Date of Patent: Apr. 16, 2002

(54) METHOD AND DEVICE FOR CLEARING YARNS

(75) Inventors: Hanspeter Wepfer, Winterthur; Johannes Heusser, Adetswil; Enrico Biondi, Glattbrugg, all of (CH)

(73) Assignee: Zellweger Luwa AG (CH)

( * ) Notice: Subject to any disclaimer, the term of this patent is extended or adjusted under 35 U.S.C. 154(b) by 0 days.

(21) Appl. No.: 09/064,718

(22) Filed: Apr. 23, 1998

(30) Foreign Application Priority Data

Apr. 23, 1997 (CH) ..... 0938/97

(51) Int. Cl.[7] ..... G06F 19/00
(52) U.S. Cl. ..... 700/144; 700/130; 700/131
(58) Field of Search ..... 700/144, 130, 700/131; 536/62, 124; 428/373

(56) References Cited

U.S. PATENT DOCUMENTS 4,991,387 A * 2/1991 Tashiro et al. ..... 57/256
5,178,008 A * 1/1993 Aemmer ..... 73/160
5,181,374 A * 1/1993 Aeppli ..... 28/277
5,537,811 A * 7/1996 Pidoux et al. ..... 57/264
5,592,849 A * 1/1997 Nakade et al. ..... 73/160
5,654,554 A * 8/1997 Feller et al. ..... 250/559.45
5,671,061 A * 9/1997 Hoeller ..... 356/429
5,782,985 A * 7/1998 Manser et al. ..... 134/10

FOREIGN PATENT DOCUMENTS

DE 4020330 A1 1/1991

* cited by examiner

*Primary Examiner*—Ayaz Sheikh
*Assistant Examiner*—Firmin Backer
(74) *Attorney, Agent, or Firm*—Burns, Doane, Swecker & Mathis, L.L.P.

(57) ABSTRACT

In a method and a device for clearing yarn, properties of the yarn are acquired and used to determine a yarn defect density profile. Yarn defects to be removed are defined by means of an adjustable clearing limit which is based on the density profile. In order to provide an optimum adjustment as frequently as possible, the clearing limit is automatically adjusted on the basis of the acquired properties in a control loop.

13 Claims, 5 Drawing Sheets

METHOD AND DEVICE FOR CLEARING YARNS

FIELD OF THE INVENTION

The present invention relates to a method and a device for clearing yarn, in which properties of the yarn are acquired and yarn defects to be removed are defined by means of an adjustable clearing limit.

BACKGROUND OF THE INVENTION

A method for clearing yarn defects with the use of adjustable limits is disclosed, for example, in CH 683 350. In this method, yarn defects are displayed and classified two dimensionally on the basis of a deviation from a setpoint value of the yarn thickness and the length of the yarn defect. The numbers of yarn defects, which have been identified and measured, are entered in a two-dimensional classification field and stored, for example, in cells. The clearing limit is adjusted in such a way that it is shifted outwards, i.e. made less restrictive, in the vicinity of cells having high numbers of yarn defects, and inwards in the vicinity of cells having low numbers of yarn defects. In this manner, the number of necessary knots or splices in the yarn is reduced.

Such a method allows the clearing limit to be positioned in any desired manner so that it may assume any desired shape. However, the sensitivity limit is set manually, rather than in an adaptive manner. Consequently, this method entails costly experiments on a yarn, which have to precede yarn production or rewinding of the yarn.

Another method for adjusting operating limits of electronic yarn clearers is disclosed in CH 681 462. In this case, during the clearing process the measured values of the count are continuously recorded and their distribution is determined. On the basis of this distribution and a preselected permissible alarm frequency, the operating limits are automatically fixed in accordance with statistical regularities.

This further method relates to the adjustment of operating limits in yarn monitoring installations where yarn count deviations, or deviations of the yarn fineness i.e. of the mean dimension of a yarn, trigger an alarm or stop production. It therefore does not relate to the response of the yarn clearers to measured and varying yarn properties. Thus, the operating limits have nothing to do with short but extreme deviations of the yarn diameter. These operating limits are independent of any lengths.

A method of achieving optimum management of a clearing limit without a high outlay therefore has not yet been provided.

SUMMARY OF THE INVENTION

The present invention achieves the object of providing a method and a device which enable the fixing and adjustment of the clearing limit for yarn clearers to be improved in such a way that an optimum adjustment may be achieved as frequently as possible, while simultaneously satisfying specific stipulations.

This object is achieved by automatically fixing the clearing limit on the basis of the acquired properties. The clearing limit, once fixed, is preferably also automatically adjusted at the yarn clearer so that it may adapt periodically or continuously to the nature and frequency of the yarn defects which arise. This may be effected on the basis of a standard or initial adjustment or on the basis of data acquired from previous production of the same article. Fixing of the clearing limit is, in this case, the result of a closed-loop control, which takes into account the measured values of properties of the yarn and various important criteria for the characteristic of the clearing limit. These criteria may be difficult to measure or may be impossible to bring into a clear mathematical relationship with the clearing limit. In a preferred embodiment, therefore, the afore-mentioned criteria are processed according to the rules of fuzzy logic. For fixing, the values of yarn defects are acquired by, for example, yarn clearers at the yarn and classified according to measured parameters in that they are filed in a classification field and modeled in accordance with preselected assumptions about yarn defects. The density of the yarn defects in the classification field is determined from the modeled yarn defects. Criteria regarding the position of the clearing limit are derived from this density.

A device according to the invention substantially comprises a control loop, having a fuzzy loop controller, an input for values of properties acquired from the yarn and units for the entry of criteria for determining or influencing the clearing limit. A control loop may alternatively comprise a plurality of inputs for values of a plurality of yarns and may be connected to a plurality of yarn clearers for outputting a common clearing limit.

Among the advantages achieved by the invention, a wide range of criteria for fashioning the clearing limit may be taken into account. These criteria may relate to the yarn, e.g. to the density of the yarn defects or to the form of the yarn package, or they may relate to the installation at which the yarn is produced or rewound, e.g. to the type of sensor (optical or capacitive). Further criteria may take into account general quality considerations such as, for example, the fact that large yarn defects are more serious than small ones or that specific defects in one region are extremely serious for the user and so on. It is equally possible for clearing limits to be adapted to the method used to measure the yarn defects. For instance, it is possible to take account of the fact that capacitive sampling of the yarn no longer fully detects very short yarn defects, whereas optical sampling detects even short yarn defects to their full extent. It is therefore possible to ensure that a yarn that is cleared with the use of optical sampling is not spliced or knotted more often than a yarn which has been capacitively sampled. The system may operate both autonomously, i.e. without any special input, on the basis of a standard initial input or it may, as a result of suitable inputs, operate in an optimized manner according to all possible desirable criteria. By virtue of the proposed modeling of the yarn defects on the basis of determined yarn defect values, it is possible to reduce the quantity of samples or yarn defect values which are necessary for producing a representative relief of the yarn defect density, and hence for fixing a clearing limit.

BRIEF DESCRIPTION OF THE DRAWINGS

There follows a detailed description of the invention by way of an example and with reference to exemplary embodiments shown in the accompanying drawings, in which.

DETAILED DESCRIPTION

Figure 1:
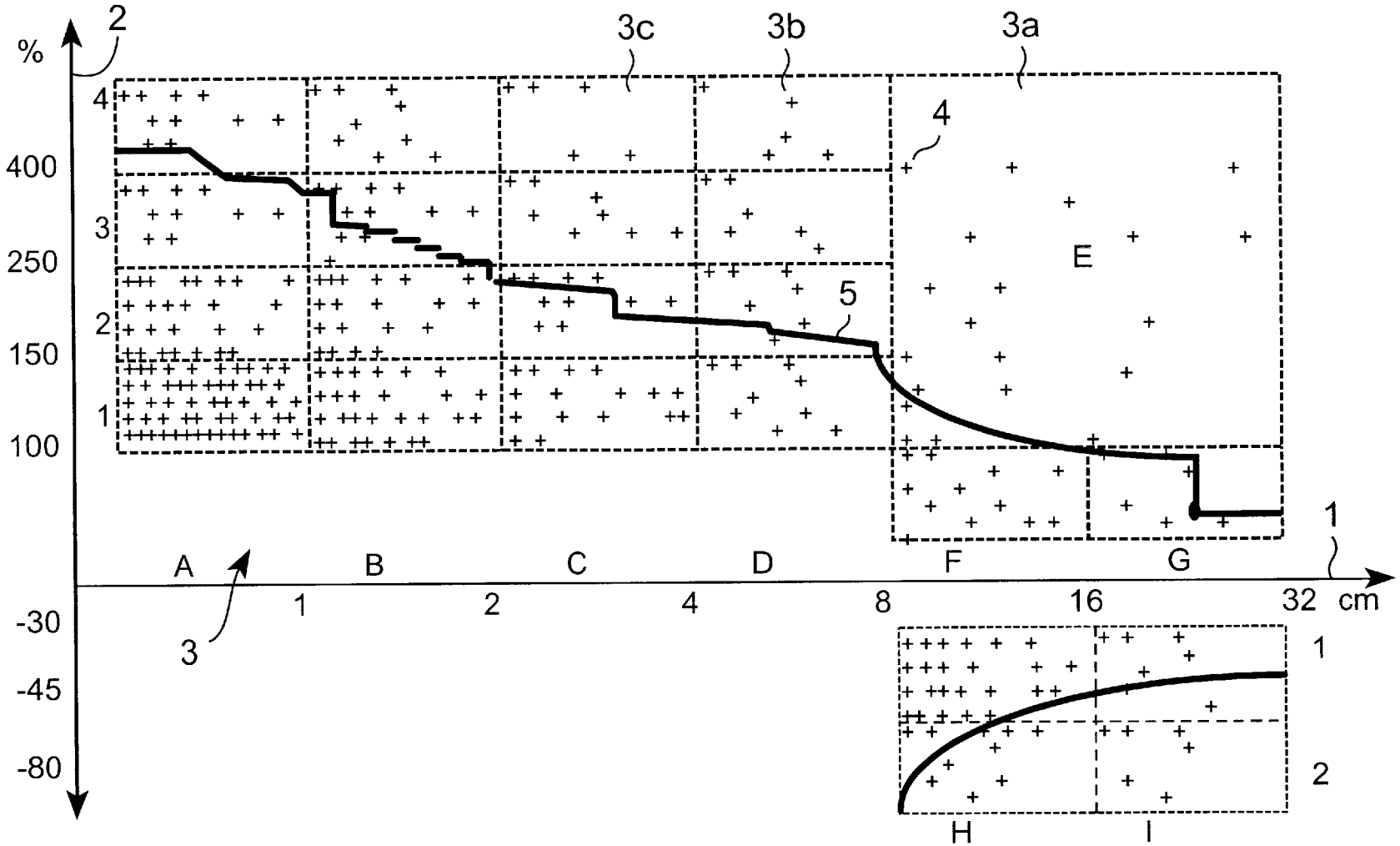
FIG. 1 is a view of a clearing limit in a classification field.

FIG. 1 shows a horizontal axis 1, along which values for a first dimension or parameter of yarn defects are recorded.

In this particular example, the parameter of interest is length. Deviations of the diameter (or mass) of a yarn in relation to a mean diameter (or mean mass) as percentages of the mean diameter (or mean mass) are plotted as a second dimension or second parameter along a vertical axis 2. Illustrated in a plane defined by these two axes 1 and 2 are fields 3, in particular fields 3*a,* 3*b,* 3*c* etc., which define classes of yarn defects, e.g. of the type described in CH 477 573 and generally known by the name of USTER CLASSIMAT. Yarn defect measurements are indicated in the plane or in the fields 3 by crosses. Cross 4, for example, indicates that the length of the yarn defect is about 8 cm and its thickness or mass exceeds the mean diameter or the mean mass by 400%. A clearing limit is denoted here by a dark line 5, and defines which yarn defects are removed or cut out of the yarn and which are not. Thus, yarn defects represented by crosses lying between the axis 1 and the clearing limit 5 are not cut out and hence do not lead to splicing or knotting of the yarn. In a first approximation it may be stated here that the clearing limit 5 goes around accumulations or clouds of crosses, and hence of yarn defects, in such a way that the latter lie between the axis 1 and the clearing limit 5.

Figure 2:
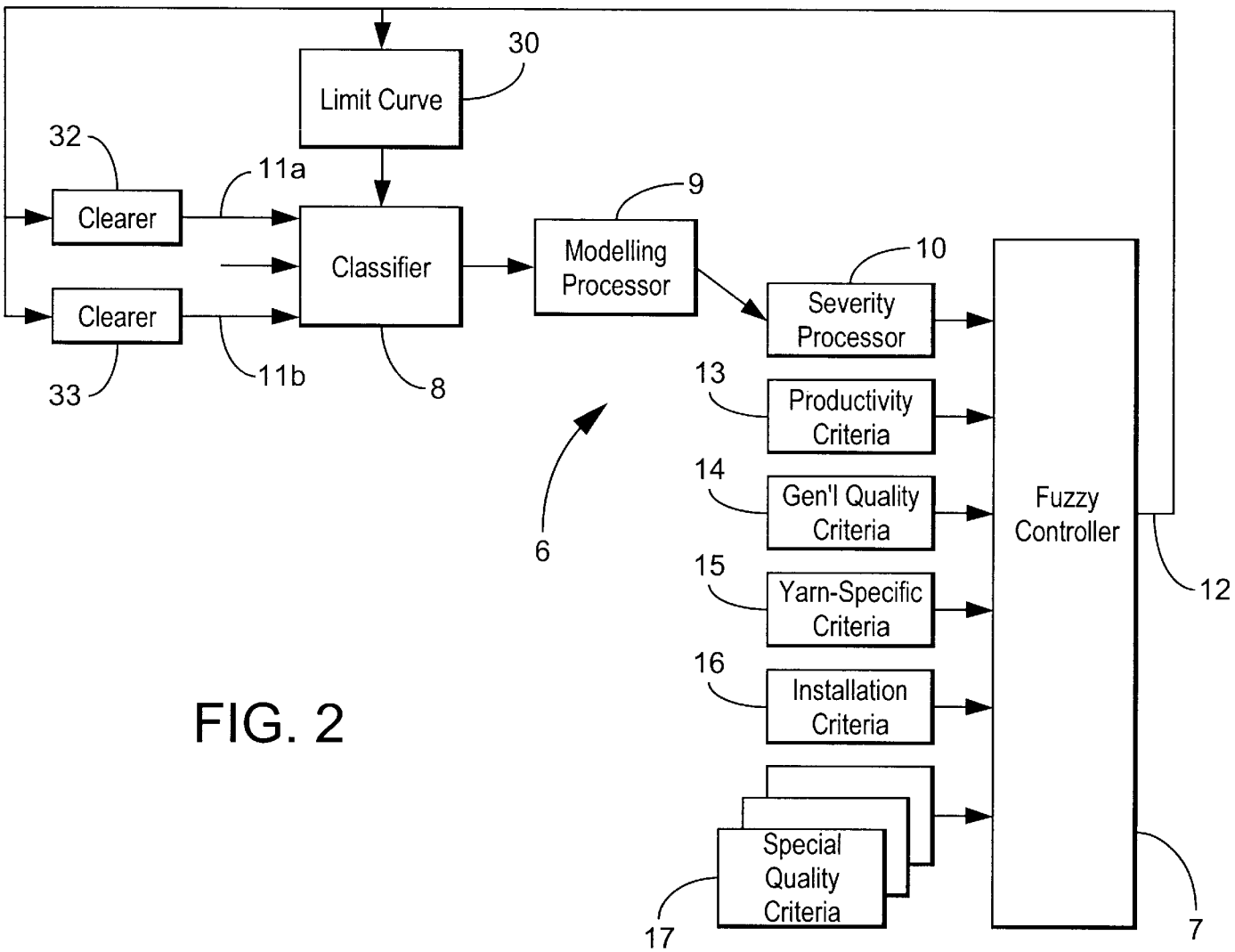
FIG. 2 is a diagrammatic view of a yarn clearing device according to the invention.

FIG. 2 shows a block diagram of the method and/or the device for clearing yarn. The device comprises a control loop 6, which comprises a loop controller 7 preferably in the form of a fuzzy controller and a plurality of processing units 8, 9 and 10 for individual method steps, which units may be implemented as part of the loop controller 7. In this exemplary embodiment, they are individually listed in order to illustrate individual functions or method steps with greater clarity. The processing unit 9 is a memory having a plurality of memory locations which store parameters (length and diameter deviation) of a yarn defect for a selectable yarn length (e.g. 100 km). The processing unit 8 has a memory and at least one input 11*a,* 11*b* for receiving measured values from an associated yarn clearer 32, 33. When the device operates a plurality of yarn clearers, a correspondingly increased number of inputs 11 is provided. The processing unit 8 is used to condition the individual measured values in the manner shown below, and substantially comprises a processor or computer or a part thereof. The processing unit 10 likewise includes a memory having a plurality of memory locations, which correspond to fields 3*a,* 3*b,* 3*c* etc. (FIG. 1). The loop controller 7, which comprises a processor or computer, also has an output 12 for values of a clearing limit and, when the loop controller takes the form of a fuzzy logic controller, has further inputs 13 for entering productivity criteria, 14 for entering general quality criteria, 15 for entering yarn-specific criteria, 16 for entering installation specific criteria and 17 for entering further or special quality criteria. The output 12 is in turn connected to the processing unit 8 so that the values of the clearing limit, as indicated by the field 30, are presented there for storage, display or output for other purposes. The loop controller 7 is also connected by the output 12 to the yarn clearers 32, 33.

Figure 3:
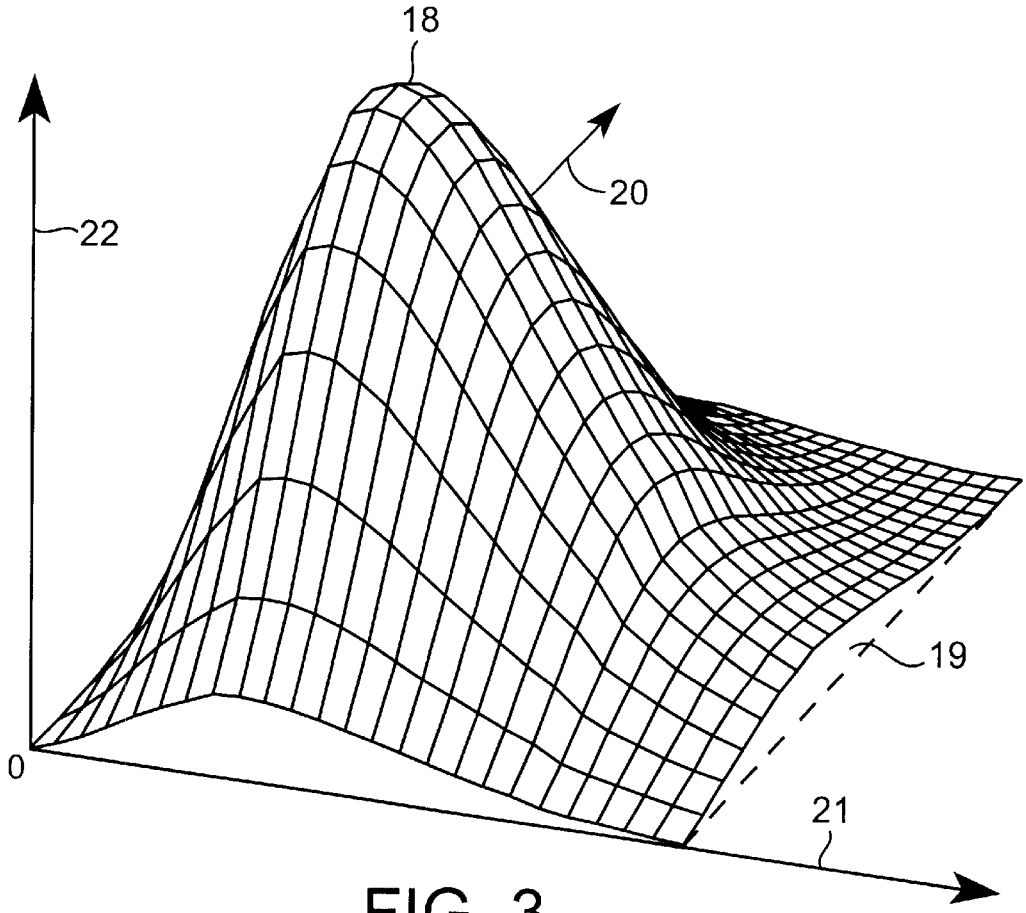
FIG. 3 is a diagrammatic view of a modeled yarn defect.

FIG. 3 shows a modeled yarn defect 18 which is plotted over a sub-area 19. A modeled yarn defect is a partial and simplified reconstruction of a yarn defect from an individual measured value. For instance, it is modeled as a Gaussian bell. Its maximum is provided at the point where normally the appropriate cross, e.g. cross 4 in FIG. 1, would lie in the classification field. A unit volume is defined under the bell. The sub-area 19 is delimited here by an axis 20, along which the radius or diameter deviations are plotted, and by an axis 21, along which the lengths of the defects are plotted. The height or the volume of the yarn defect is plotted along an axis 22.

The purpose of this representation is to correctly show the significance of a yarn defect in a classification field and later to influence values derived therefrom, such as the representation of the density of the yarn defects, in such a way that no wrong conclusions may be drawn. The danger is that the yarn defect, for later use and processing, will be interpreted merely as a field and its effect upon the environment in the classification field will be disregarded. To avoid this situation, two facts are therefore to be taken into account.

First, acquisition of the values of the yarn defects is effected with specific tolerances which are dictated by the acquisition system, e.g. non-uniform speed of the yarn. Were the same yarn defect to be measured a second time, it could easily produce different values and even be classified differently in the classification field. On the other hand, the significance of the tolerances diminishes when a great many yarn defects may be measured. By modeling the yarn defects it is therefore possible to reduce the number of measured yarn defects required to obtain a representative relief of the yarn defect density or simply to obtain sufficient yarn defect density values to fix the clearing limit. By virtue of this modeling, a representative relief of the yarn defect density is therefore obtained at an early stage, after a relatively low number of measured yarn defects, and from this relief a good clearing limit and a reliable prognosis of the cutting frequencies to be expected may be derived. It is therefore possible to ensure an improved or optimized production run in terms of quality and/or productivity, even before going into production.

Figure 4:
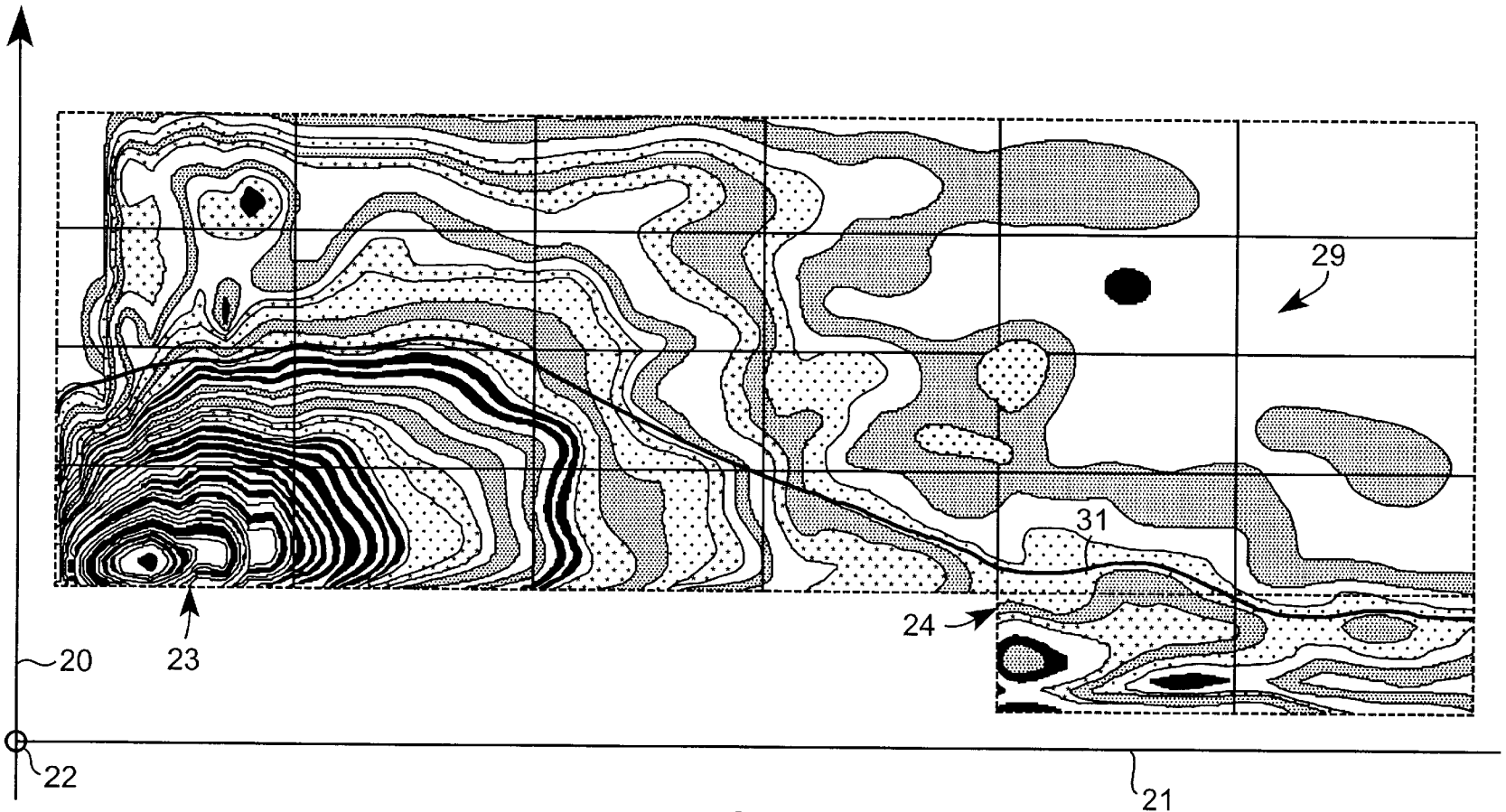
FIG. 4 is a relief of the yarn defect density.

FIG. 4 shows the sum of modeled yarn defects over a plane according to plane 3 in FIG. 1, illustrated as area 29. The modeled yarn defects are plotted over the same axes as are illustrated in FIG. 3. Here however, unlike FIG. 3, a plurality of sub-areas 19 with the total modeled yarn defects are recorded next to one another so that the modeled measured values of the individual sub-areas 19 may also still influence one another in that transitions arise between the marginal regions of the sub-areas. What may be seen in particular are high defect frequencies in a region 23, lower defect frequencies in a region 24 and no significant frequencies in adjoining regions.

Figure 5:
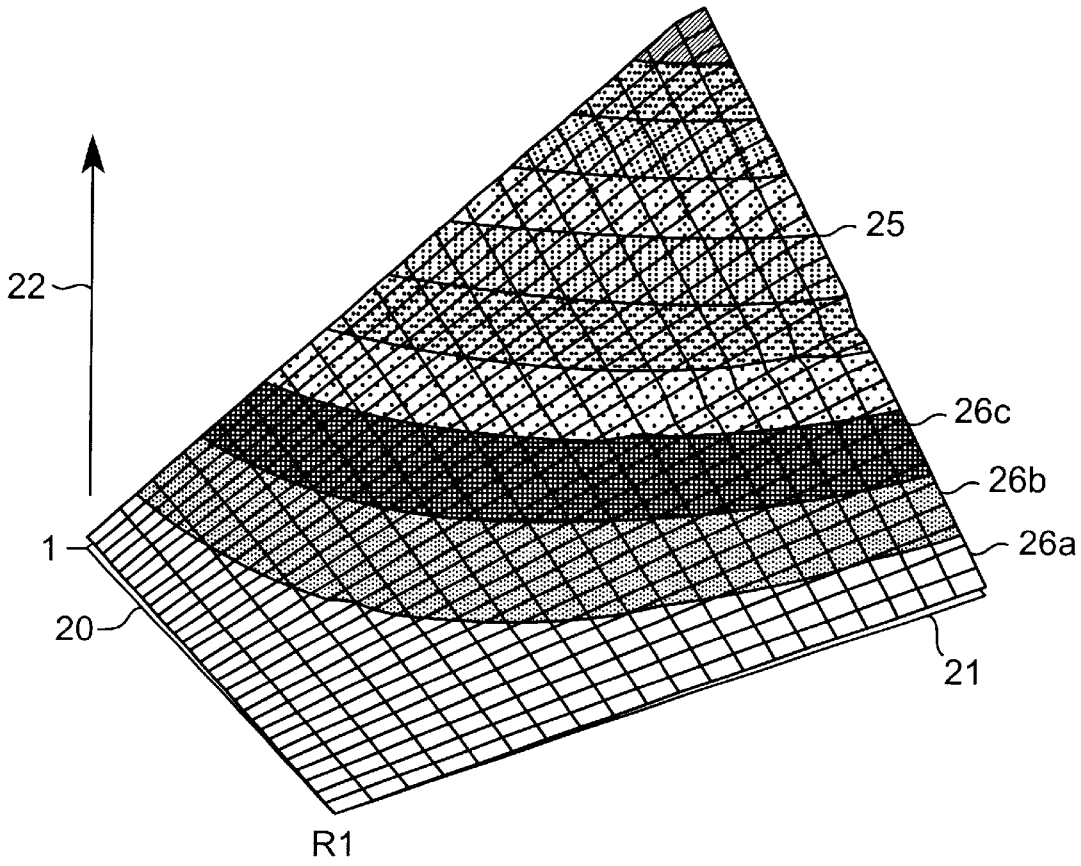
FIG. 5 is a diagrammatic view of criteria for evaluating yarn defects.

FIG. 5 shows, plotted over the same known axes 20, 21, and 22, an area 25 indicating the degree of seriousness of a yarn defect. From this it is evident, for example, that a yarn defect having a large length and a large mass or diameter deviation signifies a serious fault which may, for example, be quantified by values. For instance, regions 26*a,* 26*b,* 26*c,* etc. are defined for increasingly serious yarn defects. The mathematical function which is represented by this area is, for example, z=x y, when the point of origin is assumed to be the point of intersection of the axes 20 and 21 and when x values are plotted along the axis 20 and y values along the axis 21, or vice versa. The area 25 is therefore part of a conical surface. However, any desired area which represents the degree of seriousness in the context of the user may alternatively be defined.

The mode of operation of the invention is as follows: In a yarn clearer 32, 33, the yarn sensor detects yarn defects or measured values thereof which correspond, for example, to the diameter or the mass of the yarn. In order to classify the yarn defects according to preselected parameters—in the present case, the diameter deviation and the length of a yarn defect are selected as parameters—are related to a mean value of the diameter or the mass of they are related to mean value of the diameter of the mass of the yarn per unit of length and, on this basis, the relative deviation from the mean diameter or the mean yarn mass is calculated. In the yarn clearer these measured values are used in a likewise known manner to determine values for the length of such deviations which exceed a threshold value (for the mass or the diameter). Such measured values for the relative deviation and the length of the deviation are introduced via the input 11 into the control loop 6. There, the measured values are first presented to the processing unit 8, where they are stored. Thus, yarn defect values of a preselected yarn length are stored in the processing unit 8 and may occupy an entire classification field in the manner shown in FIG. 1 by the yarn defects indicated by crosses 4. These operations per se are already known since the classification of values measured at the yarn has long been prior art. The operations just described may also be effected for measured values of a plurality of yarns from a plurality of yarn clearers which input all of their measured values via the inputs 11 into the processing unit 8. From the processing unit 8 the contents of the memories, or simply the yarn defects, are read into the processing unit 9, where the yarn defects are modeled in the manner shown in FIG. 3. To this end, the entire classification field, i.e. all of the fields 3*a*, 3*b*, 3*c* etc. according to FIG. 1, are previously finely subdivided by means of a raster, the raster units of which may comprise one or more sub-areas 19, so that a modeled yarn defect may extend over one or more raster units. The raster may be resolved, for example, into 5% increments along the axis 2 and into 1 mm increments along the axis 1. The extension of the Gaussian bell may also be varied and should advantageously extend over a plurality of raster units. The greater the spread of the bell, the lower its height, so that the volume remains constant. The greater the distance of the yarn defect to be modeled from the point of intersection of the axes 1 and 2, the more the Gaussian bell representing it should be extended. In order to later calculate the density in a raster unit, the volumes of all of the Gaussian bell parts situated over the raster unit are added together. Then the density over the entire classification field is also calculated in a similar manner so that the density may be represented as area 29 in the manner shown in FIG. 4. The purpose of these operations is to ensure that, when determining the local yarn defect density, instead of separate discrete values arising, an area is formed which makes it possible at each location of the classification field to obtain an indication of the density of the yarn defects. This applies in particular to locations where only a few yarn defects are to be anticipated.

In parallel or previously to the above, an area 25 of the type shown in FIG. 5, which indicates a representation of the degree of seriousness of yarn defects, has been loaded into the processing unit 10. In the loop controller 7 a comparison is then effected between the now present values of the yarn defect density and preselected criteria. All of the operations in the processing units 9, 10 and in the computer 7 take place on a purely computational level, i.e. the representations shown in FIGS. 3 to 5 are to be understood as merely for the purpose of greater clarity. Through a comparison of the permitted degree of seriousness, as expressed by the area 25, and the sum of modeled yarn defects or the yarn defect density, as expressed by the area 29 (FIG. 4), it is possible to determine which of the yarn defects illustrated in FIG. 4 are unacceptable and which are not. Such a comparison is effected in the loop controller 7, which therefore takes into account a known first rule which is approximately as follows: the greater the product of mass and length of the yarn defect, the more serious the yarn defect. This rule is expressed precisely by the representation in FIG. 5. In the simplest case, a first clearing limit could therefore be obtained by partitioning the area 25 according to the area which in FIG. 4 represents the sum of the modeled yarn defects. For continuous measurements of the yarn, this sum likewise forms a continuously varying area but the area 25 remains constant over time, the cutting line and hence the clearing limit automatically adapts to altered conditions and so the loop controller 7 via the output 12 outputs the values of a clearing limit. This may occur periodically, continuously or in an externally instigated manner. A conventional loop controller 7 which is known as such from other applications is also sufficient for this purpose. The characteristic of a clearing limit is denoted in FIG. 4 by the line 31.

The clearing limit is however not optimized for all cases thereby. For this purpose it is possible to take further criteria into account. These criteria may be, for example, productivity criteria which are entered via the input 13 into the loop controller 7. Such a criterion is, for example, the number of permitted cuts per km of yarn. By means of this criterion the clearing limit is shifted as a whole or in individual regions. From the processing unit 8 the cuts provided for a preselected yarn length by the actual clearing limit 5 (=number of crosses outside of the clearing limit 5 in FIG. 1) are known and this number may be varied by altering the position of the clearing limit. General quality criteria may be entered via the input 14. For example, it may be stipulated as a rule that the clearing limit is to go around regions with a relatively high yarn defect density in the classification field. Such regions may be identified by the fuzzy loop controller when it obtains an indication of the yarn defect density from the processing unit 10 and compares this density with a setpoint entry. Yarn specific criteria may be entered via the input 15, e.g. for adapting the clearing to the yarn characteristic. As a criterion it is possible to enter, for example, a distance from the yarn package which defines a zone around the yarn package, in which defects are ignored. Installation specific criteria may also be entered via the input 16. Here, the comparability of measured values from various (optical, capacitive) clearer systems may be promoted by stipulating as a rule that for capacitively determined measured values short yarn defects are accorded greater weighting, whereas for optically determined measured values long yarn defects are accorded greater weighting. Or it may be stipulated that process-related systematic yarn defects are to be specially removed or are not to be removed at all. Further, special quality criteria could be entered via the input 17. Here, for example, particular yarn defect distributions which are an indication of special occurrences could be entered. When such a distribution has the measured values, which is compared in the fuzzy loop controller 7, an automatic compensation could be effected or an alarm triggered. These criteria, which are all entered as numerical values or as approximate data converted into numbers, are taken into account by the fuzzy loop controller 7. By means of this data the characteristic of the clearing limit 5 is varied and optimized in that the criteria are converted into setpoint entries relating to the yarn defect density and in that these setpoint entries are compared with the actual and local values of the yarn defect density. Optimized clearing limits may therefore be automatically fixed and then automatically adjusted and corrected by being automatically loaded into the yarn clearers.

Although the invention has been explained using a preferred example for properties of the yarn, i.e. the deviations of the thickness or mass and the length of the deviations, it may be realized in the same sense for other properties such as, for example, the color, the structure (hairiness, twist), or periodic diameter variations of the yarn. It could therefore be possible to fix and adjust clearing limits also for yarn defects such as foreign fibres, foreign materials, hairiness etc.

What is claimed is:

1. A method of clearing yarn, comprising the steps of:

determining properties of the yarn;

determining a density profile of predetermined properties of the yarn;

setting a clearing limit based on the determined density of said predetermined properties of the yarn; and automatically adjusting said clearing limit based on changes in said determined density.

2. A method according to claim 1, wherein the setting of the clearing limit is effected according to rules of fuzzy logic.

3. A method according to claim 1, wherein the setting of the clearing limit is effected while simultaneously taking into account subjective criteria which are difficult to measure and may not be brought into a clear mathematical relationship with the clearing limit.

4. A method for clearing yarn, comprising the steps of:

measuring values for yarn defects in a yarn;

classifying the measured values according to selected parameters;

modeling the classified values to determine density of yarn defects over a classification area;

setting a clearing limit on the basis of the determined density of the yarn defects; and clearing the yarn in accordance with said limit.

5. The method of claim 4 wherein said clearing limit is set by comparing the yarn defect density to a factor which is a product of two of said parameters.

6. The method of claim 4 wherein said yarn defect values are measured for a plurality of yarns, and said classification is based upon the measured values for said plurality of yarns.

7. A method according to claim 4, wherein the clearing limit is determined by criteria which are derived from a distribution of density and setpoint entries relating to permissible faults.

8. A device for clearing yarns, comprising:

a measurement unit which determines properties of a yarn;

a processing unit which determines a density profile for predetermined properties of the yarn;

a controller which establishes a clearing limit based upon the determined density profile and updates said clearing limit in accordance with changes in the determined density; and a clearing unit which clears defects from the yarn in accordance with said limit.

9. The device of claim 8 wherein said measurement unit, processing unit, controller and clearing unit are connected together in a control loop.

10. A device according to claim 9, wherein the control loop comprises a plurality of inputs for values of a plurality of yarns.

11. A device according to claim 8, comprising a plurality of yarn clearers which operate in accordance with a common clearing limit.

12. A device according to claim 8, wherein said controller is a fuzzy loop controller having input units for entering criteria for setting the clearing limit.

13. A method of clearing yarn, comprising the steps of:

determining properties of the yarn;

determining a density profile of predetermined properties of the yarn;

defining a criteria from a group of possible criteria at least comprising general quality criteria, productivity criteria, yarn specific criteria and installation specific criteria;

setting a clearing limit based on the determined density of predetermined properties of the yarn and said defined criteria; and automatically adjusting said clearing limit based on changes in said determined density profile and said defined criteria.

* * * * *